United States Patent [19]

Propsom

[11] Patent Number: 4,512,584

[45] Date of Patent: Apr. 23, 1985

[54] IMPROVED GAME BOARD WITH PIECES COOPERATING FOR ROTATION

[75] Inventor: George F. Propsom, Racine, Wis.

[73] Assignee: Western Publishing Company, Inc., Racine, Wis.

[21] Appl. No.: 507,381

[22] Filed: Jun. 24, 1983

[51] Int. Cl.[3] ..... A63F 3/00

[52] U.S. Cl. ..... 273/282

[58] Field of Search ..... 273/282, 291, 281, 287; 40/446, 447

[56] References Cited

U.S. PATENT DOCUMENTS

| | | | |
|---|---|---|---|
| 2,452,341 | 10/1948 | Wasserman | 273/282 X |
| 3,155,391 | 11/1964 | Chittenden | 273/291 X |
| 3,384,371 | 5/1968 | Ryan et al. | 273/281 X |
| 3,588,112 | 6/1971 | Holt | 273/282 |
| 3,599,977 | 8/1971 | Glass et al. | 273/281 |
| 3,697,077 | 10/1972 | Palmer | 273/281 |
| 3,727,916 | 4/1973 | Miller | 273/281 X |
| 3,743,293 | 7/1973 | Chodorov et al. | 273/291 X |
| 3,981,503 | 9/1976 | Tsukuda | 273/287 |

FOREIGN PATENT DOCUMENTS

| | | | |
|---|---|---|---|
| 48924 | 6/1934 | Denmark | 273/282 |

*Primary Examiner*—Richard C. Pinkham
*Assistant Examiner*—Scott L. Brown
*Attorney, Agent, or Firm*—James G. O'Neill; Ronald M. Goldman

[57] ABSTRACT

A game board (10) upon which a game is played with flat chips or discs (20) provided with different colors (22, 24) on opposite sides thereof. The game board is provided with a playing surface (12) having a plurality of openings (26) formed therein. Each of the openings is formed as a deep pocket with a shoulder (28) adjacent and below the playing surface whereby a disk (20) when placed within an opening (26) and resting on a shoulder (28) may be flipped over or rotated to show the color of the disc on the opposite side without removing the disc from the playing surface. The game board also includes a storage area (16) having two storage compartments (18) therein for holding discs when not in use.

4 Claims, 7 Drawing Figures

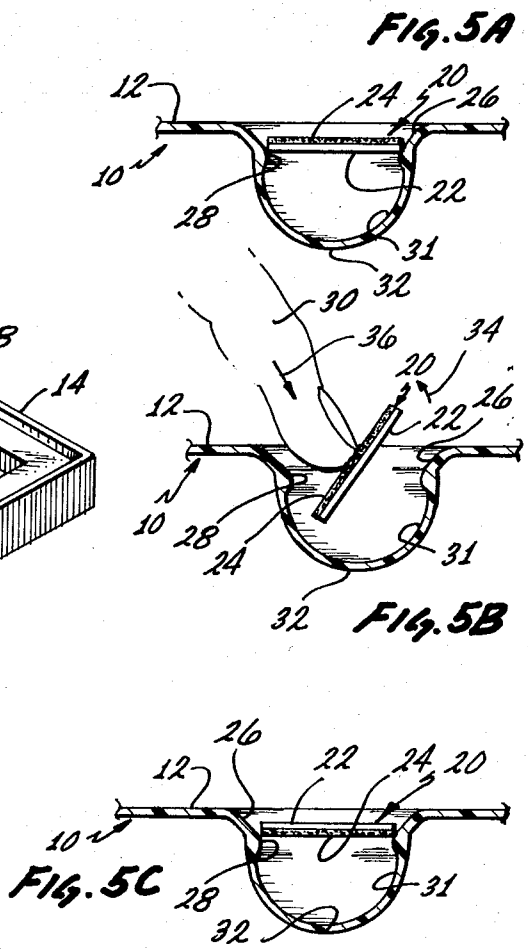
FIG. 5A
FIG. 5B
FIG. 5C
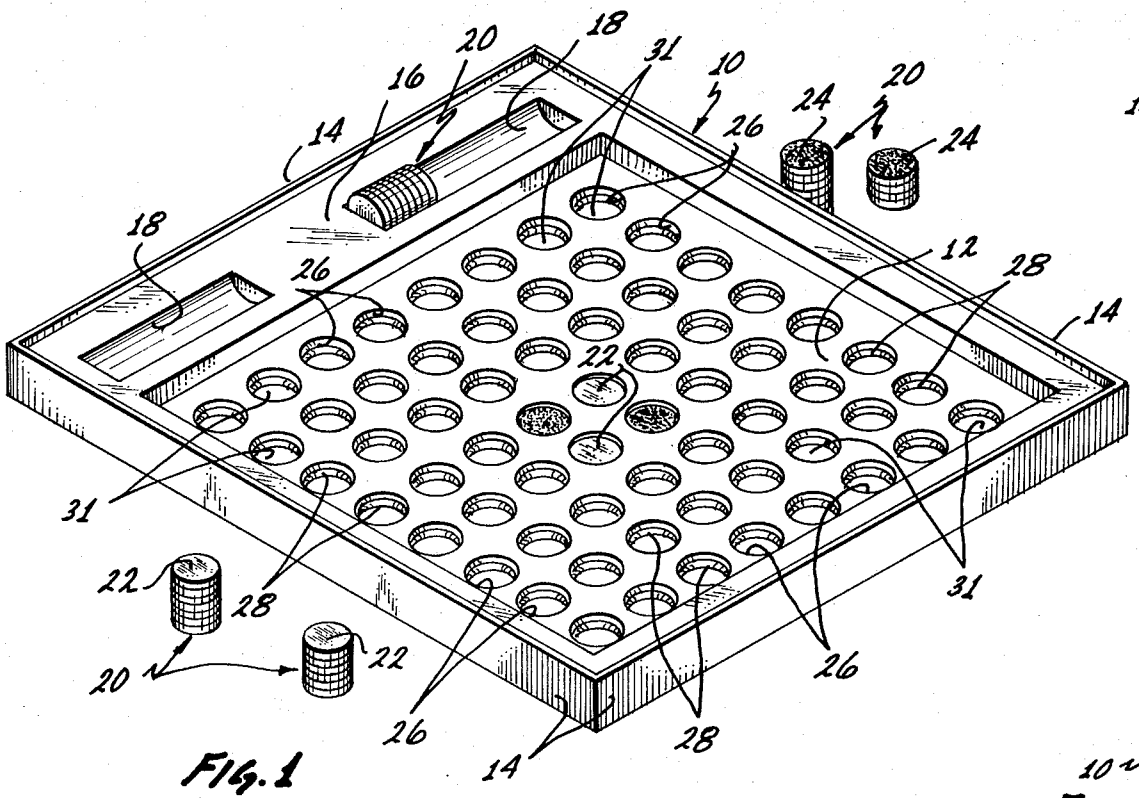
FIG. 1

IMPROVED GAME BOARD WITH PIECES COOPERATING FOR ROTATION

DESCRIPTION

TECHNICAL FIELD

This invention relates to game boards and more particularly to an improved game board to facilitate the play thereon of a game played with chips which are successively placed thereon by the players and which may be rotated or turned over during play.

BACKGROUND ART

Game boards are known having flat surfaces divided into squares, as in a checkboard, with any number of desired squares. An equal number of chips, discs or pieces may be provided, each having a diameter which fits within the squares on the board. The chips are provided with different colors on opposite sides, with all chips bearing the same colors. One such game, known as reversi, is normally played by two players who first place four chips on the central four squares, with adjacent chips showing different colors. The players select which color they will play with. The game commences, when one player places a chip showing his color, next to one of his opponents chips of the other color. The purpose of play is to eventually sandwich opponent's chips between chips of the player's color. When an opponent's chip is thus sandwiched between two chips of the player's color, the sandwiched chip is turned over to thereby show chips all of the same color. Play continues in turn, until the board is completely filled. The winner being the player having the largest number of chips showing his color.

A game board for playing the game discussed above is shown in U.S. Pat. No. 3,981,503. This patent discloses a flat game board with at least one integrally formed pocket therein for storing chips, and with a cover pivotably mounted over the pocket for movement through a slit in the board to cover and protect the chips stored therein.

A further board game having shallow recesses or depressions separated by walls between the depressions is disclosed in U.S. Pat. No. 3,588,112. The playing pieces rest or sit on the shallow bottoms of the depressions, with the playing pieces being removed from the shallow bottoms during play.

Neither of the above discussed patents or any other known art disclose a game board having deep pockets wherein playing discs are supported during play and whereby the color of a disc may be changed by merely pushing down at the edge of the disc to thereby flip over the disc to show the color on the opposite side, without removing the disc from the board.

DISCLOSURE OF THE INVENTION

In accordance with the present invention, a game board is constructed with a playing surface divided into 64 squares. Each of the squares, includes a deep depression or pocket formed therein for supporting chips well above the bottom of the pocket. During play, a chip in any pocket may be flipped or turned over by a play by merely pushing down at one edge of the chip to rotate the chip within the pocket, thereby changing the color shown on the chip.

The game board also includes at least one storage compartment on one side of the playing area for storing chips when not used. The storage area and playing surface of the board are preferrably molded from one sheet of durable material, supported by side edges which are fixed thereto.

Further objects, features, and advantages of the invention will become apparent upon a reading of the specification when taken in conjunction with the drawings, in which like reference numerals refer to like elements in the several views.

BRIEF DESCRIPTION OF THE DRAWINGS

FIG. 1 is a perspective view of the improved game board of the present invention placed on a surface with four chips in the central four squares to start a game, as well as piles of chips placed on opposite sides of the board, and within one of the storage compartments;

FIGS. 5A through 5C are partial sectional views taken along line 5—5 of FIG. 2 showing the sequence of a chip being flipped over to reverse the color of the chip.

BEST MODE FOR CARRYING OUT THE INVENTION

Figure 2:
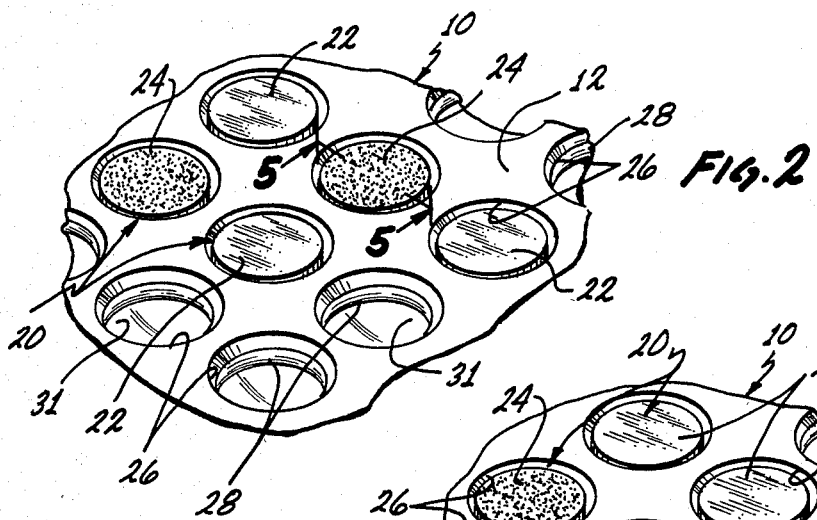
FIG. 2 is an enlarged partial perspective view of the central portion of the board of FIG. 1 showing play of the game after a further light colored chip is placed adjacent one of the dark colored chips.

Referring now to the drawings, there shown is an improved game board 10 in accordance with the present invention. The board may be manufactured or molded from any convenient material such as a plastic synthetic resin, and includes an upper game playing surface 12, separate supporting edges or sides 14, either formed integrally therewith or fixed thereto in any convenient manner, and a storage area 16 having two storage compartments 18 for holding flat, circular playing chips, discs or pieces 20. Each of the chips has two different colored sides, one light and one dark, such as white 22 and black 24.

The game board 10 may be provided with any desired number of openings 26 formed in the playing surface 12, such as 64, into which chips 20 are inserted and held in any convenient manner, such as on an enlarged shoulder 28 formed integrally within and slightly below the playing surface 12. The openings 26, the shoulders 28, and the chips 20 are all specifically sized, to enable the chips to be easily inserted in the opening, supported on the shoulder, and easily rotated when pressed with sufficient force adjacent an edge.

Figure 3:
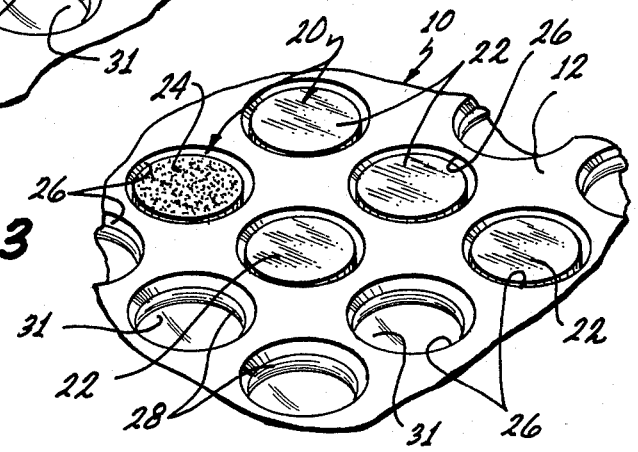
FIG. 3 is a view similar to FIG. 2 in which the central dark colored chip has been flipped over so as to show the same color as the light colored chips on either side thereof.

After four chips, two of each color showing, are placed in the center of the playing surface (FIG. 1), play of the game commences. Normally, the player who has chosen white starts, by placing one of his chips 20 with the color 22 showing adjacent a chip showing the color 24 (FIG. 2). The chip showing the color black is then flipped over (FIG. 3), in the manner shown in FIGS. 5A through C. That is, pressure is applied against the edge of the surface 24 of the chip 20 by pressing with a finger 30, or other similar shaped object, such as a pencil. This pressure, is sufficient to rotate the chip about an axis (shown perpendicular to the drawing) at the shoulder 28. In this manner, the surface 24 is rotated to the bottom and the surface 22 is rotated to the top.

Each of the openings 26 is formed as a deep depression or pocket having sloping or straight sides 31 and a flat or rounded bottom 32. A chip held within an opening 26 is supported either directly against the sides 31 or on the shoulder 28. The chips may be easily rotated, in either direction, such as shown by arrow 34, when pressed by finger 30, in the direction of arrow 36, without the chip touching the sides 31 or the rounded bottom 32.

Figure 4:
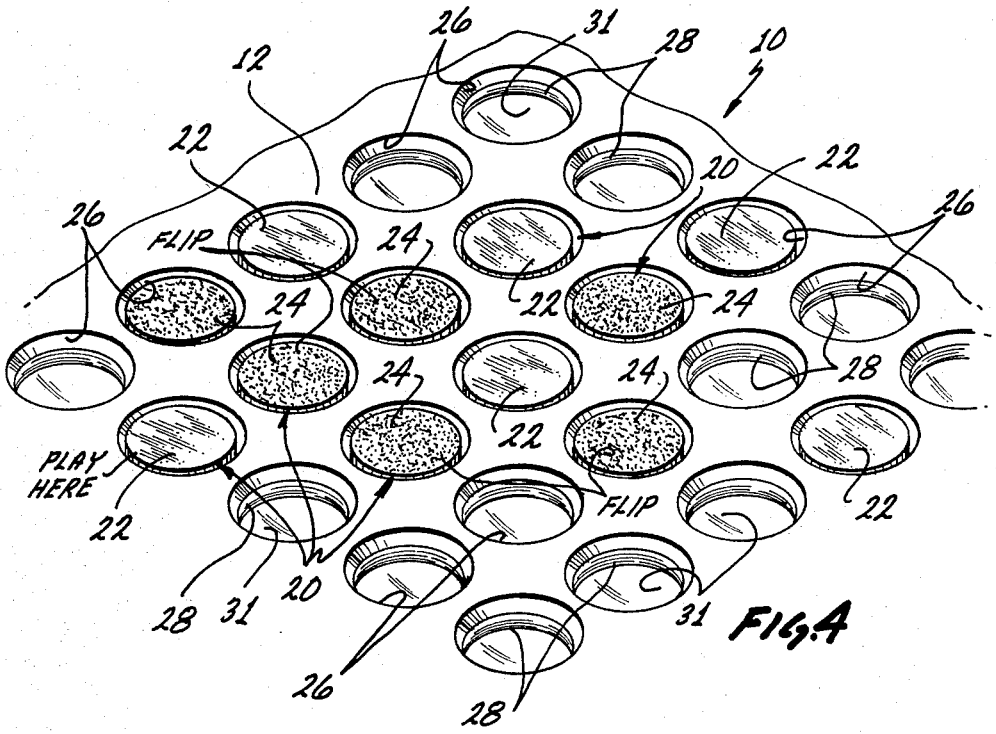
FIG. 4 is a further enlarged perspective view showing continuation of play of the game on the playing surface.

It therefore can be seen that during the play of the game, each time a chip or chips of one color are captured or sandwiched between two chips of an other color, in any direction (see FIG. 4, showing chips in both the horizontal and diagonal direction which will be flipped because of the last play of the chip showing white 22). The sandwiched chip or chips are easily and quickly rotated by merely applying pressure to the edge of the chips. The chips do not have to be removed from the game surface to be turned over and replaced on the game surface. This lessens the chance that a chip may be lost and/or placed in a different or inconvenient place on the board. The rotation of the chips also allows a game to be more speedily played, by merely fliping or rotating all sandwiched chips, until the board is full and a winner determined.

Although not clearly shown in the drawings, it is to be understood that the edges 14 of game board 10 may be integrally molded with the game board, or may be machined or molded separately, and fixed to the playing surface 12 and storage area 16, in any convenient manner, such as by an adhesive, resin or the like. In addition, game board 12 may be provided with a box or other storage medium, or may be provided with a cover to protect the contents while in storage.

While there has been shown and described a preferred embodiment of the invention, it is to be understood that there are other adaptations of modifications that may be made within the spirit and scope of the invention, as set forth in the attached claims.

I claim:

1. A rectangular game board provided with a raised support along its edges, said game board having a rectangular upper playing surface with a plurality of circular openings formed therein, each of said openings being formed as a separate deep pocket with sides and a bottom portion; and a plurality of flat circular playing chips capable of being deployed within said circular openings and resting within each of said circular openings, and means whereby, if a force is applied to any portion of the edge of a chip when supported within said opening, said chip supported in said opening will be flipped over to show the opposite side of the chip.

2. The rectangular game board of claim 1, further including a storage area adjacent said playing surface, said storage area having two storage compartments formed therein for receipt of chips when not in use.

3. The rectangular game board of claim 2, wherein in each of said circular openings said means is an enlarged circular shoulder formed adjacent and below the rectangular playing surface to support a chip therein, and said bottom portion of each deep pocket is spaced from said respective shoulder a sufficient distance to enable a chip supported on said shoulder to be rotated within said deep pocket without touching the sides and bottom of said pocket.

4. A rectangular game board provided with an integrally formed raised support along its edges for supporting said game board on a surface;

said game board having a rectangular playing surface with 64 circular openings formed therein, each of said circular openings having an enlarged circular shoulder formed adjacent and below the rectangular playing surface, and a deep pocket having sides and a rounded bottom depression formed in a position elongated from said playing surface and said shoulder;

a plurality of flat circular playing chips with different colors on opposite sides thereof, capable of being held within each of said circular openings supported on the respective circular shoulder, each of said chips when supported on a respective circular shoulder, being capable of being rotated about an axis passing through said respective circular shoulder when force is applied to any portion of the edge of said chip, whereby said chip to which said force is applied will rotate within said opening and pass above said bottom surface without touching the sides and bottom surface; and said rectangular game board including a storage area adjacent said playing surface, said storage area having two storage compartments for holding chips therein in an upright manner perpendicular to said playing surface.

* * * * *